US006328664B1

(12) United States Patent
Hammett

(10) Patent No.: US 6,328,664 B1
(45) Date of Patent: Dec. 11, 2001

(54) SPORTS TRAINING DEVICE

(76) Inventor: L. Bradley Hammett, 24 Alpine Blvd., St. Albert, Alberta (CA), T8N 2M7

( * ) Notice: Subject to any disclaimer, the term of this patent is extended or adjusted under 35 U.S.C. 154(b) by 0 days.

(21) Appl. No.: 09/275,909

(22) Filed: Mar. 24, 1999

(51) Int. Cl.[7] ..... A63B 69/00
(52) U.S. Cl. ..... 473/422
(58) Field of Search ..... 473/422, 435, 473/434, 446, 471, 476, FOR 132; 273/395, 126 R

(56) References Cited

U.S. PATENT DOCUMENTS 4,366,632 * 1/1983 Bente ..... 36/67 D
4,492,728 1/1985 Zurkinden .
5,362,045 11/1994 Hammett et al. .
5,580,048 12/1996 Mullen et al. .
5,693,413 12/1997 Hesterman et al. .

* cited by examiner

*Primary Examiner*—Sebastiano Passaniti
*Assistant Examiner*—M. Chambers
(74) *Attorney, Agent, or Firm*—Sheridan Ross P.C.

(57) ABSTRACT

An ice hockey training device is provided for rebounding a puck travelling on a playing surface. The device comprises a three-dimensional, solid, adhesive resilient body having flat, parallel top and bottom surfaces. The body is formed of tire chips held together with adhesive. The body has a vertical side edge or face which is operative to rebound a puck at substantially the same velocity with which the puck is shot against it.

7 Claims, 1 Drawing Sheet

FIG. 1
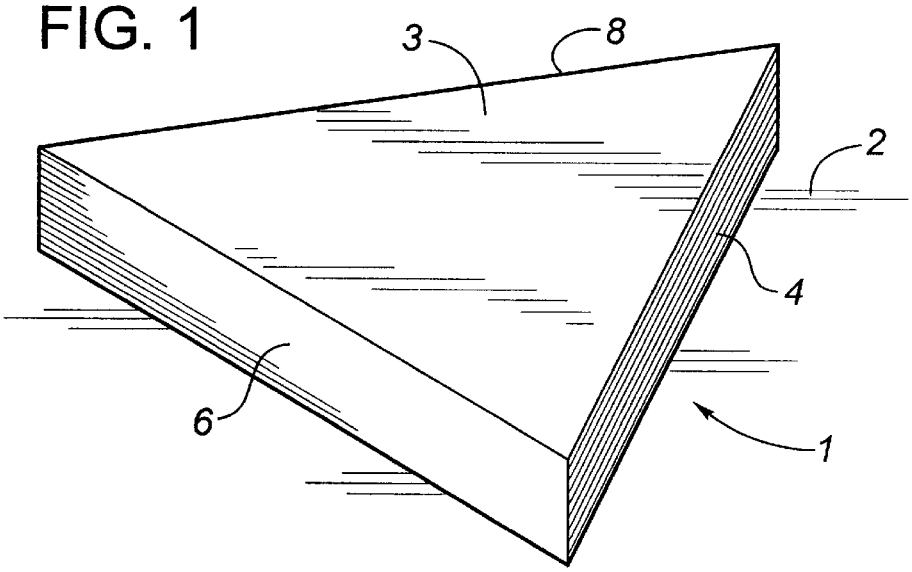
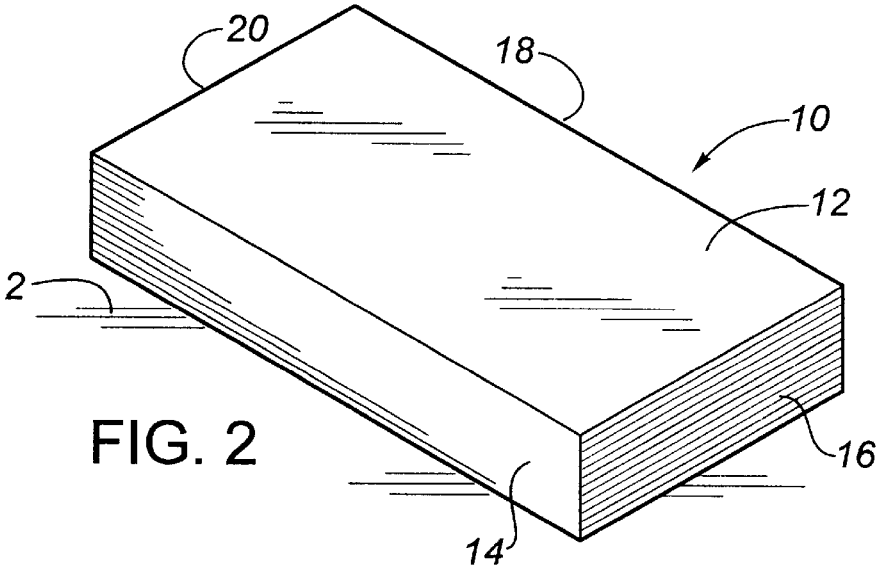
FIG. 2
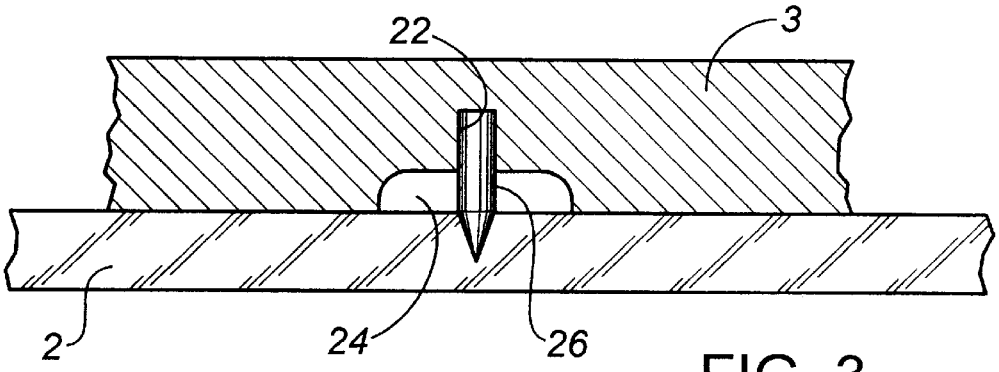
FIG. 3

SPORTS TRAINING DEVICE

FIELD OF THE INVENTION

This invention relates to an ice hockey training device which can be used by hockey players to reflect back a puck shot against it.

BACKGROUND OF THE INVENTION

In the game of hockey, it is important for a player to develop the fundamental skills of skating, shooting, passing and receiving. However, it is difficult to practice passing and receiving without the presence of another player. Therefore, there is a need for a suitable and practical device that would allow a player to practice his puck passing and receiving skills in isolation.

A hockey practice device is taught in U.S. Pat. No. 5,362,045, issued to Hammett et al on Nov. 8, 1994. This hockey practice device comprises at least two support members with an elongated elastic band placed in tension between the support members so that a puck shot against the elastic band will rebound to the shooter.

There are several drawbacks associated with the Hammett et al device. More particularly, it is desirable that the puck rebound from the device at substantially the same velocity with which it is shot at the device. The elastic band rebounds the puck at a lesser velocity. In addition, the elastic band often deflects when hit with a puck at a certain velocity and angle, with the result that the puck can pass beneath it or can get wedged underneath it. In either instance, the practice session would have to be stopped so that these problems can be rectified. Another drawback associated with the Hammett et al device is that there is a "dead zone" of approximately 2 inches on either side of the post where the puck will not rebound with sufficient speed to return to the shooter. Finally, the elastic band loses its resilience over time and has to be replaced.

The present invention addresses these concerns.

SUMMARY OF THE INVENTION

In accordance with the invention, the puck-rebounding device is a three-dimensional, solid, resilient body formed of elastomer chips or strips held together with adhesive. The body has a vertical side edge or face for rebounding a puck at substantially the same velocity with which the puck is shot against it. In a preferred form, the body is formed of tire chips, has an equilateral triangular or rectangular shape and has flat, parallel top and bottom surfaces.

The benefits of having an ice hockey training device comprised of a solid mass of resilient material are numerous. There are no moving parts to be concerned with and no adjustments necessary to ensure proper resilience of the device. There are no "dead zones" anywhere on the face of the device and therefore the puck will be returned to the shooter regardless of where on the face the puck is shot.

In a preferred embodiment, the bottom surface of the resilient body forms one or more openings for receiving pins operative to secure the body to an ice surface. The openings preferably have an enlarged diameter on the bottom surface to allow fingers to easily grasp the pins for removal. The pins have sharp ends for penetrating the ice to allow the device to sit flush against the ice. Once in position, the device cannot be easily moved. Hence, there is no possibility that the puck can get lodged beneath the device.

Broadly stated, the invention is an ice hockey training device for rebounding a puck shot against it, said device comprising a three-dimensional, solid, resilient body having a flat bottom surface for lying flush on an ice surface, said body being made from elastomer chips or the strips and adhesive, said body having a side surface capable of rebounding the puck with a velocity substantially the same as the velocity with which it was shot.

BRIEF DESCRIPTION OF THE DRAWINGS

FIG. 1 is a perspective view of the ice hockey training device wherein the body is an equilateral triangle.

FIG. 2 is a perspective view of the training device wherein the body is a rectangle.

FIG. 3 is a cross-sectional view of the lower end of the training device showing one of the openings for receiving the ice securing pin.

DESCRIPTION OF THE PREFERRED EMBODIMENT

FIG. 1 illustrates a preferred embodiment of the training device. The device 1 comprises a three-dimensional, solid, resilient body 3 made from a moldable material consisting of about 91% by weight rubber chips, about 6% by weight of adhesive and about 3% by weight of dye. The overall weight of the device 1 is preferably about 26 Kg. In plan, it has the configuration of an equilateral triangle.

The body 3, when positioned on the ice 2 lies flush thereon and has three vertical faces 4, 6 and 8. Each vertical face 4, 6 and 8 is typically 36 inches long and 3 inches wide. Testing has shown that, when the body 3 is formed using the formulation given in the preceding paragraph, a puck can be shot against any of the faces 4, 6 and 8 and it will be reflected back with a velocity substantially the same as the velocity with which it was shot.

FIG. 2 is another preferred embodiment of the training device. The device 10 is comprised of a rectangular body 12 made from a moldable material consisting of about 91% by weight rubber chips, about 6% by weight of adhesive and about 3% by weight of dye. The overall weight of the device 10 is preferably about 18 Kg.

The body 12, when positioned on the ice 2 lies flush thereon and has four vertical faces 14, 16, 18 and 20. Vertical faces 14 and 18 are both 36 inches long and 3 inches wide. Vertical faces 16 and 20 are both 10 inches long and 3 inches wide. Testing has shown that, when the body 12 is formed using the formulation given in the preceding paragraph, a puck can be shot against any of the faces 14, 16, 18 and 20 and it will be reflected back with a velocity substantially the same as the velocity with which it was shot.

FIG. 3 is an enlarged elevation view, partially cut away, of the device's ice securing pin arrangement. The bottom surface of the body 3 forms one or more recesses 22. The depth of the recess 22 is such that when a pin 26 is inserted into the recess, a sufficient portion of the pin 26 remains exposed so that the pin 26 can be embedded into the surface of the ice 2, to anchor or secure the body on the ice. In a preferred embodiment, the recess has a sufficient diameter to allow fingers to grasp the pin 26 for its easy removal.

The embodiments of the invention in which an exclusive property or privilege is claimed are defined as follows:

1. An ice hockey training device for rebounding a puck shot against it, said device comprising a three dimensional, solid, resilient body having a flat bottom surface for lying flush on an ice surface, said body being made from elastomer chips or strips and adhesive, said body having a side surface capable of rebounding the puck with a velocity substantially the same as the velocity with which it was shot.

2. The training device as set forth in claim 1 wherein the body is made of tire chips.

3. The training device as set forth in claim 2 wherein the body bottom surface forms a plurality of recesses for receiving pins operative to secure the body to an ice playing surface.

4. The training device as set forth in claim 3 wherein the body side surface is vertical and the body is an equilateral triangle in plan.

5. The training device as set forth in claim 4 wherein the sides of the triangular body are about 36 inches long and 3 inches high.

6. The training device as set forth in claim 1 wherein the body bottom surface forms a plurality of recesses for receiving pins operative to secure the body to an ice playing surface.

7. The training device as set forth in claim 6 wherein the body side surface is vertical and the body is an equilateral triangle in plan.

* * * * *